US009834949B2

(12) United States Patent
Deguchi et al.

(10) Patent No.: US 9,834,949 B2
(45) Date of Patent: Dec. 5, 2017

(54) PRESTRESSED CONCRETE ROOF FOR CYLINDRICAL TANK

(71) Applicant: IHI Corporation, Tokyo (JP)

(72) Inventors: Tomoko Deguchi, Tokyo (JP); Kazuhide Kuriyama, Tokyo (JP)

(73) Assignee: IHI CORPORATION, Tokyo (JP)

( * ) Notice: Subject to any disclaimer, the term of this patent is extended or adjusted under 35 U.S.C. 154(b) by 0 days.

(21) Appl. No.: 14/967,615

(22) Filed: Dec. 14, 2015

(65) Prior Publication Data

US 2016/0097211 A1 Apr. 7, 2016

Related U.S. Application Data

(63) Continuation of application No. PCT/JP2014/073482, filed on Sep. 5, 2014.

(30) Foreign Application Priority Data

Sep. 10, 2013 (JP) ..... 2013-187391

(51) Int. Cl.
*E04H 7/20* (2006.01)
*E04B 7/10* (2006.01)
(Continued)

(52) U.S. Cl.
CPC ..... *E04H 7/20* (2013.01); *E04B 7/102* (2013.01); *E04B 7/107* (2013.01); *E04H 5/02* (2013.01);
(Continued)

(58) Field of Classification Search
CPC .. E04H 7/02; E04H 7/20; E04H 7/065; E04H 7/18; E04H 7/04; E04H 7/10;
(Continued)

(56) References Cited

U.S. PATENT DOCUMENTS 2,223,418 A * 12/1940 Hewett ..... E04B 7/08 109/1 S
3,025,993 A * 3/1962 Horton ..... E04H 7/18 220/560.05
(Continued)

FOREIGN PATENT DOCUMENTS

JP 58-83775 A 5/1983
JP 7-4111 A 1/1995
(Continued)

OTHER PUBLICATIONS

International Search Report dated Oct. 14, 2014 in PCT/JP2014/073482 (2 pages).

*Primary Examiner* — Jessica Laux
(74) *Attorney, Agent, or Firm* — Rothwell, Figg, Ernst & Manbeck, P.C.

(57) ABSTRACT

A prestressed concrete roof for a cylindrical tank is provided with a plurality of prestressed concrete (PC) steel members which are disposed side by side in a circumferential direction at an outer circumferential side of a discoid roof and each of which extends in a radial direction, in which the plurality of PC steel members are made up of both arm parts of folded PC steel members that are folded so as to be open to the outer circumferential side of the roof in a plan view.

11 Claims, 4 Drawing Sheets

(51) Int. Cl.

| | |
|---|---|
| ***E04H 5/02*** | (2006.01) |
| ***E04H 5/08*** | (2006.01) |
| ***E04H 7/28*** | (2006.01) |
| *E04C 5/12* | (2006.01) |

(52) U.S. Cl.
CPC ..... *E04H 5/08* (2013.01); *E04H 7/28* (2013.01); *E04C 5/125* (2013.01)

(58) Field of Classification Search
CPC .. E04H 7/102; E04H 7/28; E04H 7/00; E04C 5/12; E04C 5/01; E04C 5/04; E04C 5/06; E04C 5/0613; E04C 5/0622; E04C 5/0627; E04C 5/0631; E04C 5/0636; E04C 5/064; E04C 5/065; E04C 5/166; E04G 21/163
See application file for complete search history.

(56) References Cited

U.S. PATENT DOCUMENTS

| | | | | |
|---|---|---|---|---|
| 3,292,317 | A * | 12/1966 | Barrett | E04H 7/20 376/296 |
| 2004/0216415 | A1* | 11/2004 | Pfeiffer | E04C 5/02 52/506.01 |
| 2015/0197953 | A1 | 7/2015 | Shiomi et al. | |
| 2015/0267434 | A1 | 9/2015 | Shiomi et al. | |
| 2016/0083957 | A1 | 3/2016 | Yamada et al. | |

FOREIGN PATENT DOCUMENTS

| | | |
|---|---|---|
| JP | 2011-219140 A | 11/2011 |
| JP | 2011-251741 | 12/2011 |

* cited by examiner

PRESTRESSED CONCRETE ROOF FOR CYLINDRICAL TANK

This application is a continuation application based on a PCT Patent Application No. PCT/JP2014/073482, filed on Sep. 5, 2014, whose priority is claimed on Japanese Patent Application No. 2013-187391, filed on Sep. 10, 2013. The contents of both the PCT Application and the Japanese Application are incorporated herein by reference.

TECHNICAL FIELD

The present disclosure relates to a prestressed concrete roof for a cylindrical tank.

BACKGROUND ART

As is well known, prestressed concrete (PC) construction methods for introducing prestress are used in large cylindrical concrete structures such as ground tanks for storing liquefied natural gas (LNG) or liquefied petroleum gas (LPG). The PC construction methods include methods of using bonded PC steel members as PC steel members and methods of using unbonded PC steel members as PC steel members. The PC construction method using the bonded PC steel members has the following processes. First, sheaths are arranged before concrete is poured. Bonded PC steel members such as PC steel rods, PC steel wires, or PC steel stranded wires (PC steel strands), are inserted into the sheaths before or after the concrete is cured, and are strained when the concrete reaches the desired strength. Afterwards, a material such as cement milk enters the sheaths under pressure in order to perform an anti-corrosion treatment and to bind and integrate the bonded PC steel members and the concrete. On the other hand, in the PC construction method using the unbonded PC steel members, grease is applied to PC steel members, and their surroundings are covered with sheaths.

As a prestressed concrete roof for a cylindrical tank, as disclosed in, for instance, Patent Documents 1 and 2, a technique for arranging PC steel members at an outer circumferential side of a discoid roof in a radial direction and thereby supporting strength against bending moment generated adjacent to the outer circumference side of the roof is known.

CITATION LIST

Patent Documents

Patent Document 1: Japanese Unexamined Patent Application, First Publication No. 2011-251741

Patent Document 2: Japanese Unexamined Patent Application, First Publication No. H07-4111

SUMMARY

Technical Problem

In the related art, a radial compressive force caused by PC steel members may be applied to an outer circumferential side of the roof, whereas a radial tensile force opposite to the radial compressive force may be applied to an inner circumferential side positioned inside of the PC steel members in the roof. Since the opposite force is applied in this way, stress tends to be concentrated around inner circumferential ends of the PC steel members in the roof. To relieve the concentration of the stress, a technique for alternately arranging long PC steel members and short PC steel members in a circumferential direction is known.

However, since the stress is still concentrated on an anchoring part of the inner circumferential end of each PC steel member, there is a need to use large anchoring tools or form thick wall parts or reinforced parts around the anchoring parts. As a result, the weight and manufacturing cost of the roof are increased.

The present disclosure has been made in view of the aforementioned problems, and an object of the present disclosure is to provide a prestressed concrete roof for a cylindrical tank, which minimizes increases in the weight and manufacturing cost of the roof and inhibits stress from being concentrated on anchoring parts of PC steel members arranged at an outer circumferential side of the roof.

Solution to Problem

According to first aspect of the present disclosure, there is provided a prestressed concrete roof for a cylindrical tank, which includes a plurality of prestressed concrete (PC) steel members which are disposed side by side in a circumferential direction at an outer circumferential side of a discoid roof and each of which extends in a radial direction, in which the plurality of PC steel members are made up of both arm parts of folded PC steel members that are folded so as to be open to the outer circumferential side of the roof in a plan view.

Advantageous Effects

According to the present disclosure, in the prestressed concrete roof for a cylindrical tank, it is possible to limit an increase in the weight and manufacturing cost of the roof and inhibit stress from being concentrated on the anchoring parts of the PC steel members arranged at the outer circumferential side of the roof.

DESCRIPTION OF EMBODIMENTS

Hereinafter, an embodiment of the present disclosure will be described with reference to the drawings. In the present embodiment, a cylindrical prestressed concrete (PC) double shell storage tank for storing liquefied natural gas (LNG) will be described as an example.

Figure 1:
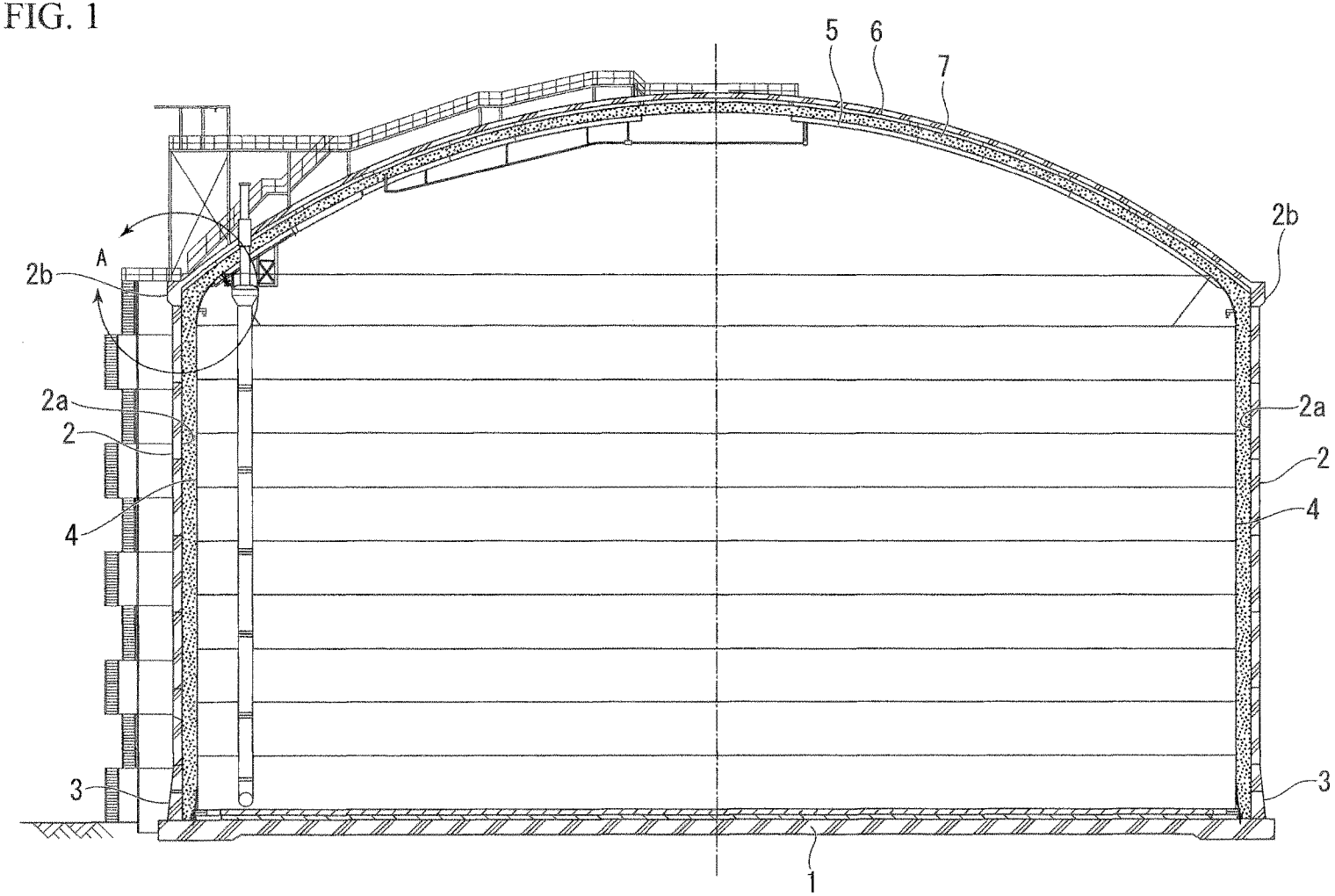
FIG. 1 is a vertical sectional view of a cylindrical tank in an embodiment of the present disclosure.

The construction of the cylindrical tank (PC structure) of the present disclosure will be described with reference to FIG. 1. First, a discoid base (bottom part of an outer tank) 1 is laid, and a base part 3 for building a PC wall (sidewall of the outer tank) 2 is provided to protrude at an outer circumferential edge of the base 1.

Next, lateral liners (outer tank lateral plates) 2*a* are built on the base 1 along an inner side of the base part 3 and up to an uppermost level of the cylindrical tank. Concrete is poured and cured on the base part 3 along the built lateral liners 2*a*, and the PC wall 2 is built sequentially from a lowermost level to an uppermost level according to the number of levels of the lateral liner 2*a*.

An inner tank sidewall 4, an inner tank roof 5, and an outer tank roof 6 are appropriately assembled, and thereby the cylindrical tank acting as the double shell storage tank having an inner tank made of a metal and an outer tank made of prestressed concrete is constructed. In the drawings, a reference sign 2*b* indicates a ring-shaped beam part formed at an upper end of the PC wall 2, and a reference sign 7 indicates a cold insulator filled between the inner tank and the outer tank.

Figure 2:
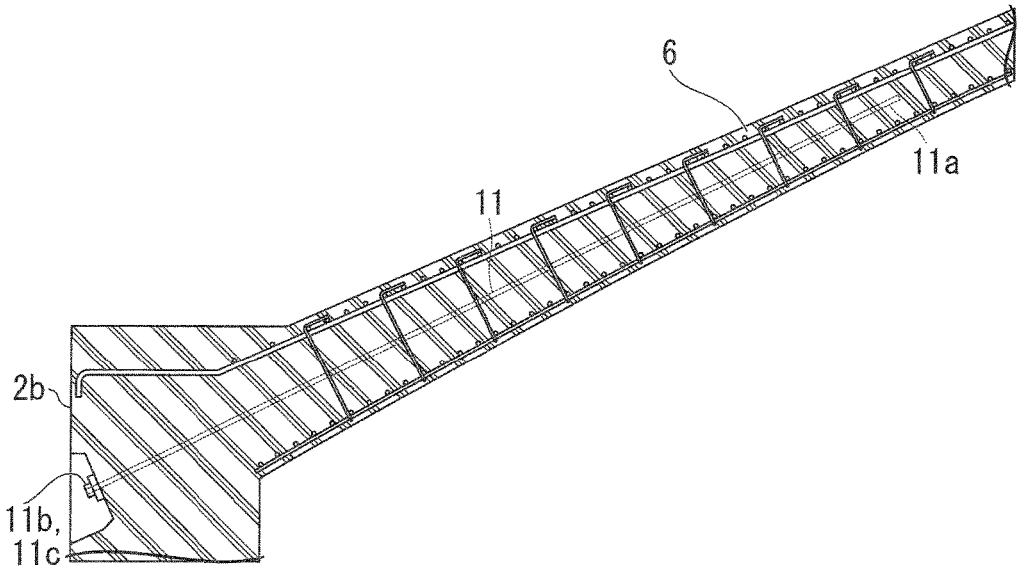
FIG. 2 is an enlarged view of a part A of FIG. 1.

As shown in FIG. 2, a thickness of the outer tank roof (hereinafter referred to simply as a "roof") 6, which has an approximate disc shape and bulges upward, increases toward an outer circumferential side. Thus, resistance to bending moment caused by a dead load of the roof 6 is increased. Reinforcing bars are appropriately arranged in the roof 6 in radial and circumferential directions of the roof 6.

Figure 3:
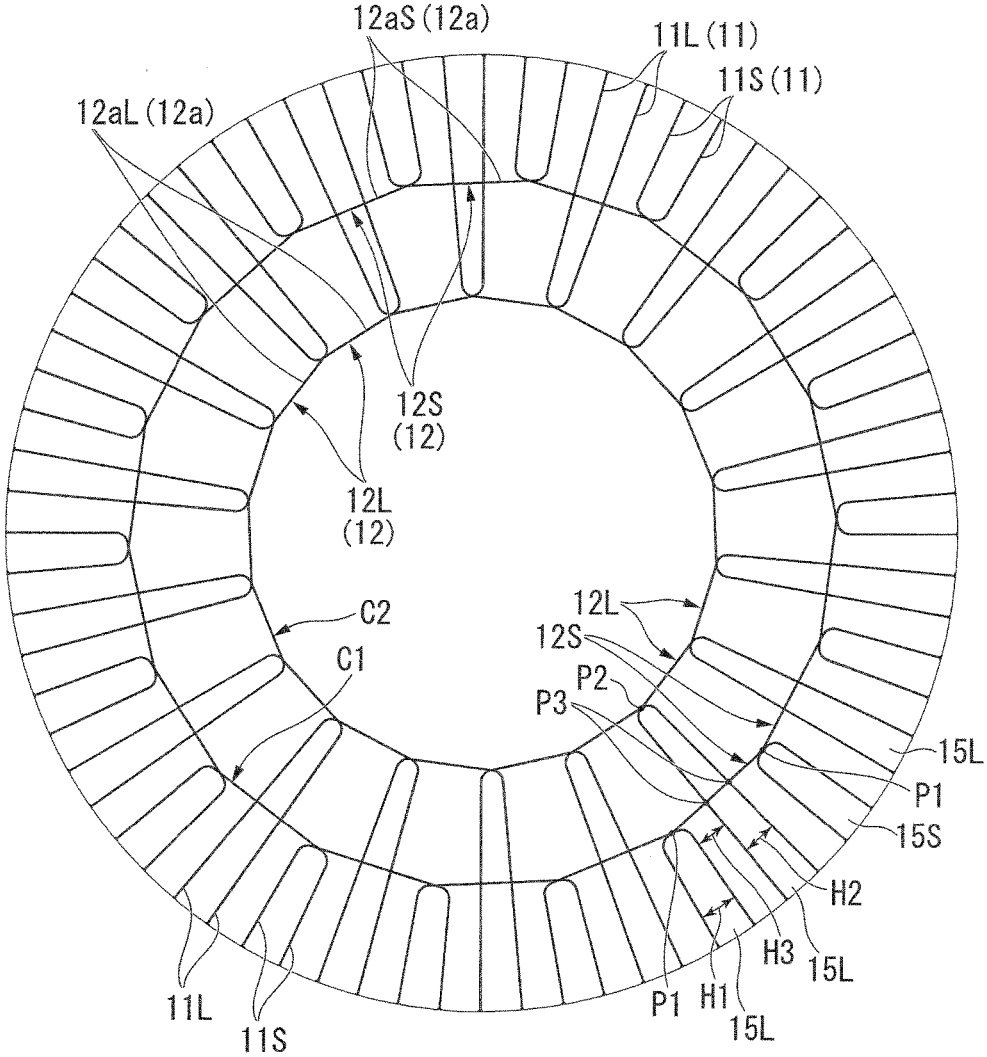
FIG. 3 is a plan view showing an arrangement of prestressed concrete (PC) steel members in a prestressed concrete roof of the cylindrical tank in the embodiment of the present disclosure.

Hereinafter, FIG. 3 is also referred. A plurality of PC steel members 11, each of which extends in a radial direction, are arranged in a circumferential direction at an outer circumferential side excluding a predetermined region of an inner circumferential side in the roof 6. Thus, compressive prestress in the radial direction is applied to the outer circumferential side of the roof 6. Each of the PC steel members 11 is inserted into the outer circumferential side of the roof 6 so as to pass an intermediate portion of the roof 6 in a thickness direction of the roof 6. Each of the PC steel members 11 is inclined relative to a horizontal direction to follow a slope of the outer circumferential side of the roof 6. It is preferable to arrange the PC steel members 11 closer to an upper surface of the roof 6 since compressive prestress against the bending moment cause by a dead load of the roof 6 can be efficiently given.

An inner circumferential end 11*a* of each PC steel member 11 is anchored by a folded part 12*a* to be described below. An outer circumferential end 11*b* of each PC steel member 11 is fixed at an outer circumferential side of the beam part 2*b* of the PC wall 2 using an anchoring tool 11*c*.

The PC steel members 11 are formed, for instance, by inserting PC steel wires into sheaths. After the inner circumferential end 11*a* of each PC steel wire is anchored, the outer circumferential end 11*b* of each PC steel wire is pulled and tensioned by, for instance, a jack, and each PC steel wire is held and fixed in a tensed state using an anchoring tool 11*c* with a predetermined tension applied. Afterwards, the interiors of the sheaths are grouted to stick the PC steel wires to the roof 6, and thereby compressive prestress is given to the roof 6. A PC steel member or arm part is not limited to the PC steel wire, and may be a PC steel rod, a PC steel stranded wire, or the like.

The PC steel members 11 include both arm parts of folded PC steel members 12 that are folded so as to be open to the outer circumferential side of the roof 6 in a plan view. To be specific, the folded PC steel members 12 are bent in a U shape in a plan view. A pair of PC steel members 11 formed by both the arm parts of the folded PC steel member 12 and a folded part 12*a* extending between both the arm parts (that is, between the inner circumferential ends 11*a* of the pair of the PC steel members 11) are integrally formed. The folded part 12*a* anchors the inner circumferential ends lla of the pair of the PC steel members 11 continuing with the folded part 12*a*. The outer circumferential ends 11*b* of the pair of PC steel members 11 pass through the beam part 2*b*, and are fixed in a state in which they are pulled toward the outer circumference.

The type of the PC steel member 11 includes a short PC steel member (or arm part) 11S and a long PC steel member (or arm part) 11L which are different in length in a radial direction. Also, the folded PC steel member 12 includes a short folded PC steel member 12S including the short PC steel members 11S, and a long folded PC steel member 12L including the long PC steel members 11L. The radial length of the long folded PC steel member 12L (i.e., including long PC steel member 11L) is about twice that of the short folded PC steel member 12S (i.e., including short PC steel member 11S).

Among the plurality of short folded PC steel members 12S, the short folded PC steel members 12S that are adjacent to each other in a circumferential direction are disposed such that lateral portions thereof including the short PC steel members 11S overlap each other. Hereinafter, the overlap portion between the short folded PC steel members 12S that are adjacent to each other in the circumferential direction is referred to as a short overlap portion 15S.

The folded parts 12*a* (hereinafter referred to as "folded parts 12*a*S") of the plurality of short folded PC steel members 12S are disposed to be arranged on the same circumference of the roof 6 in a plan view. Thus, a first circle C1 on which the plurality of folded parts 12*a*S stand in line at positions of the inner circumferential ends of the plurality of the short PC steel members 11S is formed.

Among the plurality of long folded PC steel members 12L, the long folded PC steel members 12L that are adjacent to each other in a circumferential direction are disposed such that lateral portions thereof including the long PC steel members 11L overlap each other. Hereinafter, the overlap portion between the long folded PC steel members 12L that are adjacent to each other in the circumferential direction is referred to as a long overlap portion or second overlapping portion 15L. Accordingly, as should be apparent from the foregoing, the arrangement includes a plurality of PC steel members 12, including a plurality of first PC steel members 12S and a plurality of second PC steel members 12L, with the first PC steel members shorter than the second. Further, each of the first PC steel members 12S includes first arm parts (11S) and a first folded part (12*a*S), and each of the second PC steel members 12L includes second arm parts (11L) and a second folded part (12*a*L). In addition, as shown in FIG. 3, adjacent first PC steel members overlap to form first overlapping portions (reflected by the adjacent arms 11S), and similarly, adjacent second folded PC steel members overlap to form second overlapping portions (reflected by the regions between adjacent arm parts 11L in FIG. 3). See also first (15S) and second (15L) overlapping portions in FIG. 4, and the discussion of overlapping portions 15S and 15L below.

The folded parts 12*a* (hereinafter referred to as "folded parts 12*a*L") of the plurality of long folded PC steel members 12L are disposed to be arranged on the same circumference of the roof 6 in a plan view. Thus, a second circle C2 on which the plurality of folded parts 12*a*L stand in line at positions of the inner circumferential ends of the plurality of the long PC steel members 11L is formed.

Figure 4:
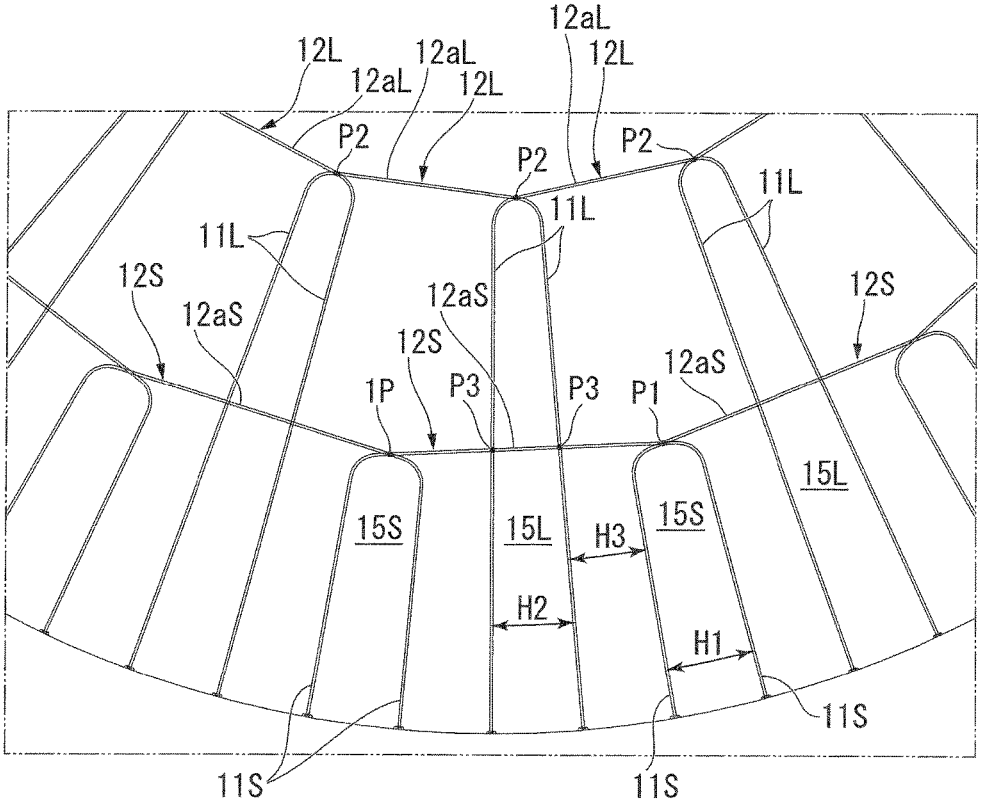
FIG. 4 is a partially enlarged view of FIG. 3.

FIG. 4 is also referred. The short overlap portions 15S (first overlapping portions) and the long overlap portions 15L (second overlapping portions) are disposed to be alternately arranged in the circumferential direction. Circumferential widths (i.e., angles in FIGS. 3 and 4) H1 of the short overlap portions 15S are uniform, and circumferential widths (i.e., angles in FIGS. 3 and 4) H2 of the long overlap portions 15L are uniform. Also, the widths H1 and H2 are the same as each other. Also, the widths H1 and H2 and an interval (i.e., angle in FIGS. 3 and 4) H3 in a circumferential direction between the long and short overlap portions 15L and 15S that are adjacent are the same as each other. Thus, at the outer circumferential side positioned outside of the second circle C2, all of the PC steel members 11 are disposed so as to be arranged at regular intervals in the circumferential direction. To be specific, the short PC steel members 11S at both sides of the short overlap portions 15S and the outer circumferential sides of the long PC steel members 11L at both sides of the long overlap portions 15L are disposed to be arranged at regular intervals in the circumferential direction.

A first intersection P1 at which bent portions of the short folded PC steel members 12S adjacent in the circumferential direction intersect each other in a plan view is present at the inner circumferential side of each short overlap portion 15S. A second intersection P2 at which bent portions of the long folded PC steel members 12L adjacent in the circumferential direction intersect each other in a plan view is present at the inner circumferential side of each long overlap portion 15L. A pair of third intersections P3 at which the folded parts 12*a*S and the pair of long PC steel members 11L intersect each other in a plan view are present at the inner circumferential side of each short folded PC steel member 12S. Two PC steel members 11 intersect each other at the intersections P1, P2 and P3 in a state in which positions thereof are different in a thickness direction of the roof 6.

The pair of third intersections P3 and the first intersections P1 at both sides thereof are out of alignment in a circumferential direction. The second intersection P2 is out of alignment to the first intersection P1 and the third intersection P3 in a radial direction. That is, three or more of the PC steel members 11 do not intersect one another at each of the intersections P1, P2 and P3. Therefore, an increase in thickness of the roof 6 at each of the intersections P1, P2 and P3 can be limited.

As described above, according to the present embodiment, the plurality of PC steel members 11 extending in the radial direction are disposed at the outer circumferential side of the discoid roof 6 side by side in the circumferential direction. The plurality of PC steel members 11 are made up of both the arm parts of the folded PC steel members 12 that are folded so as to be open to the outer circumferential side of the roof 6 in a plan view. Thus, by using the folded parts 12*a* extending between both the arm parts of the folded PC steel members 12 as the anchoring parts of the inner circumferential ends 11*a* of the PC steel members 11 formed by both the arm parts of the folded PC steel members 12, tension load of the PC steel members 11 can be dispersed to all the folded parts 12*a*. For this reason, stress concentration at the anchoring parts of the inner circumferential ends 11*a* of the PC steel members 11 can be limited. As a result, there is no need to use large anchoring tools or form thick wall parts or reinforced parts around the anchoring parts, and an increase in the weight and manufacturing cost of the roof 6 can be minimized.

The present disclosure is not limited to the above embodiment. All the shapes and combinations of the means and components represented in the aforementioned embodiment are only examples, and can be variously modified based on design requirements without departing from the spirit and scope of the present disclosure.

For example, in the above embodiment, the application to the LNG tank has been described as an example. However, the present disclosure may be applied to various prestressed concrete structures such as an LPG tank in addition to the LNG tank.

According to the present disclosure, by using the folded parts extending between inner circumferential ends of both of the arm parts of the folded PC steel members as anchoring parts of inner circumferential ends of the PC steel members formed by both the arm parts of the folded PC steel members, the tension load of the PC steel members can be dispersed to all the folded parts. For this reason, stress concentration at the anchoring parts of the inner circumferential ends of the PC steel members can be limited. As a result, there is no need to use large anchoring tools or form thick wall parts or reinforced parts around the anchoring parts, and increases in the weight and manufacturing cost of the roof 6 can be minimized.

Further, radial positions of the anchoring parts of the inner circumferential ends of the short PC steel members (i.e., folded parts of the short folded PC steel members) and radial positions of the anchoring parts of the inner circumferential ends of the long PC steel members (i.e., folded parts of the long folded PC steel members) are out of alignment with each other, and therefore the stress concentration on the anchoring parts of the inner circumferential ends of the PC steel members can be more effectively limited.

Further, the short folded PC steel members adjacent in the circumferential direction and the long folded PC steel members adjacent in the circumferential direction overlap each other in the circumferential direction. Thereby, it is possible to give prestress to the entire region in the circumferential direction. Also, the short overlap portions and the long overlap portions are alternately arranged, and all the PC steel members are arranged at regular intervals in the circumferential direction. Thereby, the prestress can be uniformly given.

INDUSTRIAL APPLICABILITY

According to the present disclosure, in the prestressed concrete roof for a cylindrical tank, an increase in weight and manufacturing cost of the roof can be minimized, and stress concentration at the anchoring parts of the PC steel members arranged at the outer circumferential side of the roof can be limited.

The invention claimed is:

1. A prestressed concrete roof made of prestressed concrete for a cylindrical tank, wherein the prestressed concrete roof includes a disc shaped portion, and wherein the prestressed concrete roof further comprises:

a plurality of PC steel members which are disposed side by side in a circumferential direction at an outer circumference of the disc shaped portion, and wherein each of the PC steel members extends in a radial direction, wherein the plurality of PC steel members each comprise two arm parts and a folded part extending between the two arm parts, and wherein the two arm parts are arranged to have an opening therebetween so as to be open toward the outer circumference of the roof in a plan view, and wherein the folded parts of the PC steel members are arranged so as to form at least one circle in the plan view.

2. The prestressed concrete roof made of prestressed concrete for a cylindrical tank according to claim 1, wherein:

the plurality of PC steel members include a plurality of first PC steel members and a plurality of second PC steel members, wherein the first PC steel members are different in radial length compared to the second PC steel members; and wherein the first PC steel members each include first arm parts and a first folded part, and wherein the second PC steel members each include second arm parts and a second folded part.

3. The prestressed concrete roof made of prestressed concrete for a cylindrical tank according to claim 2, wherein:

portions of each first PC steel member overlap portions of an adjacent first PC steel member in the circumferential direction to form first overlapping portions;

portions of each second PC steel member overlap portions of an adjacent second PC steel member in the circumferential direction to form second overlapping portions; and the first overlapping portions and the second overlapping portions are alternately arranged in the circumferential direction.

4. The prestressed concrete roof made of prestressed concrete for a cylindrical tank according to claim 3, wherein:

the first PC steel members are shorter in the radial direction than the second PC steel members, with the first arm parts shorter in the radial direction than the second arm parts; and the first folded parts are closer to the outer circumference than the second folded parts.

5. The prestressed concrete roof made of prestressed concrete for a cylindrical tank according to claim 4, wherein:

the at least one circle in the plan view comprises a first circle and a second circle, wherein the second circle is positioned radially inward of the first circle in the plan view;

the first folded parts of the first PC steel members form the first circle; and the second folded parts of the second PC steel members form the second circle.

6. The prestressed concrete roof made of prestressed concrete according to claim 5, wherein widths of the first overlapping portions in the circumferential direction are the same as widths of the second overlapping portions in the circumferential direction.

7. The prestressed concrete roof made of prestressed concrete according to claim 6, wherein a width between each first overlapping portion and each second overlapping portion next thereto is the same as the widths of the first overlapping portions and the second overlapping portions in the circumferential direction.

8. The prestressed concrete roof made of prestressed concrete according to claim 3, wherein widths of the first overlapping portions in the circumferential direction are the same as widths of the second overlapping portions in the circumferential direction.

9. The prestressed concrete roof made of prestressed concrete according to claim 8, wherein a width between each first overlapping portion and each second overlapping portion next thereto is constant in the circumferential direction throughout the circumferential direction.

10. The prestressed concrete roof made of prestressed concrete according to claim 3, wherein a width between each first overlapping portion and each second overlapping portion next thereto is constant in the circumferential direction throughout the circumferential direction.

11. The prestressed concrete roof made of prestressed concrete for a cylindrical tank according to claim 2, wherein:

the at least one circle in the plan view comprises a first circle and a second circle, wherein the second circle is radially inward of the first circle in the plan view;

the first folded parts of the first PC steel members form the first circle; and the second folded parts of the second PC steel members form the second circle.

* * * * *